US006250320B1

(12) United States Patent
Roth

(10) Patent No.: US 6,250,320 B1
(45) Date of Patent: Jun. 26, 2001

(54) SUN COVER APPARATUS

(76) Inventor: Ronald Roth, 5217 E. Sheena Dr., Scottsdale, AZ (US) 85254

( * ) Notice: Subject to any disclaimer, the term of this patent is extended or adjusted under 35 U.S.C. 154(b) by 0 days.

(21) Appl. No.: 09/429,090

(22) Filed: Oct. 29, 1999

(51) Int. Cl.[7] ..... E04H 15/64
(52) U.S. Cl. ..... 135/87; 135/118; 135/119
(58) Field of Search ..... 135/114, 115, 135/118, 120.3, 87, 909; 52/4, 63, 55, DIG. 14

(56) References Cited

U.S. PATENT DOCUMENTS

| | | | | |
|---|---|---|---|---|
| 2,130,919 | * | 9/1938 | Erickson et al. | 135/118 X |
| 3,093,874 | * | 6/1963 | Rapata | 135/119 X |
| 3,866,619 | * | 2/1975 | Per Frisk | 135/118 X |
| 4,068,673 | | 1/1978 | Bernardi . | |
| 4,367,761 | | 1/1983 | Winant . | |
| 4,750,508 | | 6/1988 | Tatoian . | |
| 4,966,181 | | 10/1990 | Liberman et al. . | |
| 5,080,123 | * | 1/1992 | Stein | 135/114 X |
| 5,415,194 | | 5/1995 | Kaye . | |
| 5,487,402 | | 1/1996 | Clary . | |
| 5,881,495 | * | 3/1999 | Clark | 135/118 X |

* cited by examiner

*Primary Examiner*—Peter M. Cuomo
*Assistant Examiner*—Michael J. Fisher
(74) *Attorney, Agent, or Firm*—Robert Ryan Morishita; Anderson & Morishita

(57) ABSTRACT

A protective cover assembly which includes a lightweight square or rectangular cover fabricated of a breathable type water resistant fabric or solar screen material, having a metal grommet installed into each corner. The assembly also includes four hollow tubular support poles that each have a top-mounted flange to keep the grommet in position, with each pole further including a pivoting two-sided toggle which would prevent the grommet from slipping off the pole after installation. The assembly also includes four solid steel ground spikes that each have a top-mounted bar with a spring-loaded lock tab and a side-mounted spike drive flange. Each spike driver flange would be used to hammer a spike into the ground and could also serve to aid in removing the spikes with the claw of the hammer. Each of the corner poles would fit snuggly over the top-mounted bar that is located on the top of each spike, and each locking tab would removably connect with a hole in the side of the pole. Larger units of the assembly would include a sewn pocket running from one side to the other through the center of said cover, allowing a fiberglass reinforcing rod to be inserted to prevent bowing from collected rain water or for preventing excessive flapping due to high winds.

2 Claims, 3 Drawing Sheets

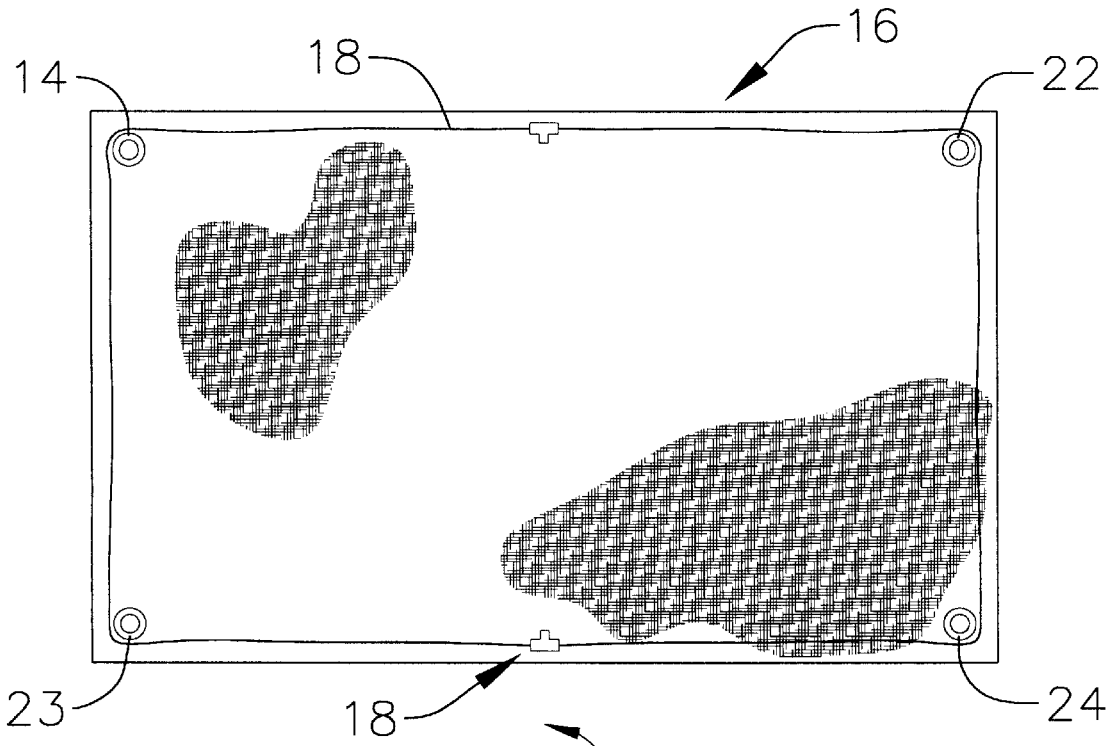
FIG. 2
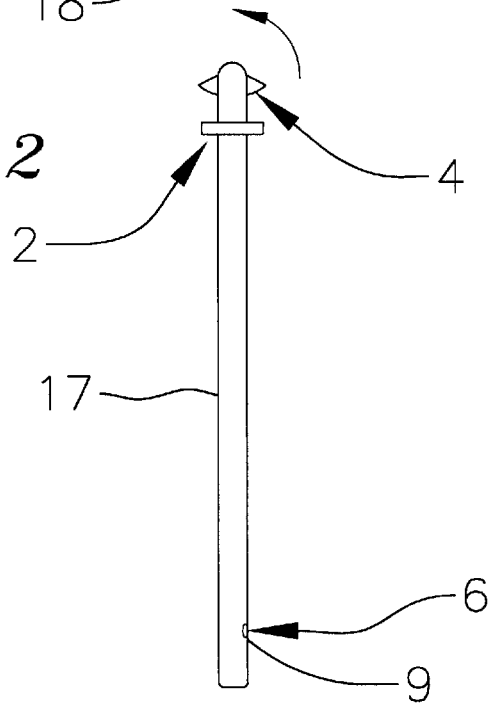
FIG. 3
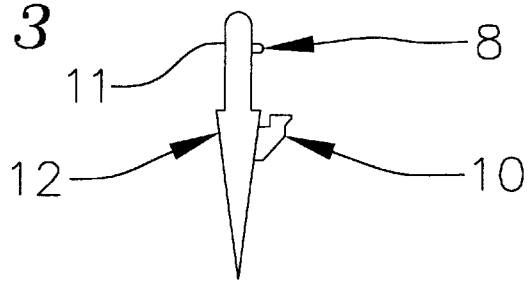

SUN COVER APPARATUS

I. BACKGROUND OF THE INVENTION

The present invention relates to a cover system and more specifically relates to a cover system for providing an easily deconstructed and constructed cover for a boat, jet ski, or other personal item. Said cover system comprises a lightweight square or rectangular cover, said cover being fabricated of a breathable type water resistant fabric or solar screen material, four hollow tubular support poles, and four solid steel ground spikes.

II. DESCRIPTION OF THE PRIOR ART

In the prior art, there exists plenty of cover systems that are presently available for use. One such example is U.S. Pat. No. 5,487,402, issued to Clary, which discloses a portable shelter having a frame whose members freely move between a maximum and a minimum dimension to enable selectively applied, various size shelter skins to the frame and to tautly stretch the shelter skin thereon. The skin also comprises slidable tension means that stretch the skin over a portion of the frame. The upper portion of the shelter is partially supported by a lifting force applied thereto. The first end of each post is connected to the first ends of the other posts, and the second ends of each post engages a support surface.

U.S. Pat. No. 5,415,194, issued to Kaye, discloses a securing structure that comprises a first ring member, second and third ring members adjacent to the first ring member, a locking member, a cord insertible through the second and third ring members, respectively, and engageable by a locking member. The first, second and third ring members sit in a panel, form a triangular relationship and are formed with openings, with the opening in the first ring member larger than the openings in the second and third ring members.

U.S. Pat. No. 4,966,181, issued to Liberman et al., discloses a pole and fabric body assembly for beach use, requiring only three support poles for providing the fabric body with what is applicably recharacterized as a shallow triangular shape, wherein the angular orientation of each of the supported sides of the fabric body is adequate to reflect the wind, and wherein the windward side thereof is nevertheless perceived as a rectangular display in which indicia, preferably provided by color but possibly also consisting of word messages or the like, is readily observed and thus functions as a visual signal for locating the device, particularly on a crowded beach.

U.S. Pat. No. 4,750,508, issued to Tatoian, discloses a collapsible sunshade for erecting on a sandy beach. Said sunshade includes a polygonal sail member and a compliment of supporting poles corresponding to the comers of the sail member, said poles being particularly flexible for maintaining a desired tension in the sail member without requiring accurate positioning of the poles in the sand. The poles each have a triangular trough shaped blade member for securely anchoring in wet or dry sand with a low level of downwardly directed force being required for penetration of the poles into the sand.

U.S. Pat. No. 4,367,761, issued to Winant, discusses a shelter which comprises panels of fabric which are inner-connected in their upper part along an edge of curvilinear shape whose concavity faces outwardly and is adapted to receive support posts at the outer ends of this edge, and tensioning means extending from the lower edge of the panels at two points spaced apart a distance less than that between the points receiving the posts.

U.S. Pat. No. 4,068,673, issued to Bernardi, discloses and awning type sunshade particularly for beaches, gardens and the like, comprising a supporting frame associated with a support member. At an intermediate point of the supporting frame the ends of a pair of telescoping arms are articulated. At the other ends, the arms are connected with the ends of a front member which is movable with respect to the supporting frame. The arms are pivotable at an intermediate point about a substantially perpendicular axes with respect to the front member direction of movement.

As can be seen by the prior art, there is no prior art which substantially features all of the individual characteristics of the present invention. None of the prior art contains a cover which is mountable on support poles in a non-tying fashion, as is present in the current invention. In addition, none of the prior art contains spikes or support means that include a spike driver or other similar mechanism to assist a user in inserting a spike into the ground and later removing said spike from the ground.

III. SUMMARY OF THE INVENTION

The present invention comprises a lightweight square or rectangular cover fabricated of a breathable type water resistant fabric or solar screen material, said cover having a metal grommet installed into each comer. The type of fabric could actually vary, depending on the climate of the area in which it is being used. For instance, in Arizona the user might want a fabric that would include more UV protection, in Louisiana a user might want more rain resistant protection in a fabric, and in Nevada, a user might want fabric that provides additional dust protection.

The present invention also includes four hollow tubular support poles to support said cover, each of said poles having a top mounted flange to keep the grommet in position at the top of the assembly, and also including a pivoting two sided toggle which would prevent the grommet from slipping off the pole after installation. Said invention would also include four solid steel ground spikes, each of said spikes having a top mounted bar with a spring loaded lock tab and a side mounted spike driver flange. The spike driver flange would be used to hammer the spike into the ground and could also serve to aid in removing the spikes with the claw of the hammer. Each of the comer poles would fit snugly over the top mounted bar that is located on the top of each spike, and locking tab on said top mounted bar would mate with a hole in the side of the pole, serving to lock the components together.

Said invention would come in a wide variety of sizes. Larger units of said invention would include a sewn pocket running from one side to the other and the center of said cover, allowing a fiberglass reinforcing rod to be inserted to prevent bowing from collected rain water or for preventing excessive flapping due to high winds. The fiberglass rod would be slightly curved to hold the cover up higher in the center, resulting in the rain water immediately running off.

It is therefore an object of this invention to provide a lightweight tarpaulin type cover that would be held in the air by means of four comer support poles.

It is another object of this invention to provide a lightweight tarpaulin type cover that would be held in the air by means of four comer support poles that contain a mechanism to prevent the cover from being detached from the support poles.

It is another object of this invention to provide adequate anchoring and supporting means to the support poles, while also allow the support poles to be easily moved if so desired by a user.

It is another objection of this invention to provide extra support to said lightweight tarpaulin type cover to insure rainwater or wind will not knock over or affect said cover.

Other objects, features and advantages of the present invention will become more readily apparent from the following detailed description of the preferred embodiment when considered with the attached drawings and the appended claims.

IV. BRIEF DESCRIPTION OF THE DRAWINGS

FIG. 1 depicts a top view of the tarp attached to the present invention.

FIG. 2 depicts a side view of a support pole of the present invention.

FIG. 3 depicts a side view of a spike of said invention.

V. DESCRIPTION OF THE PREFERRED EMBODIMENT

Figure 4:
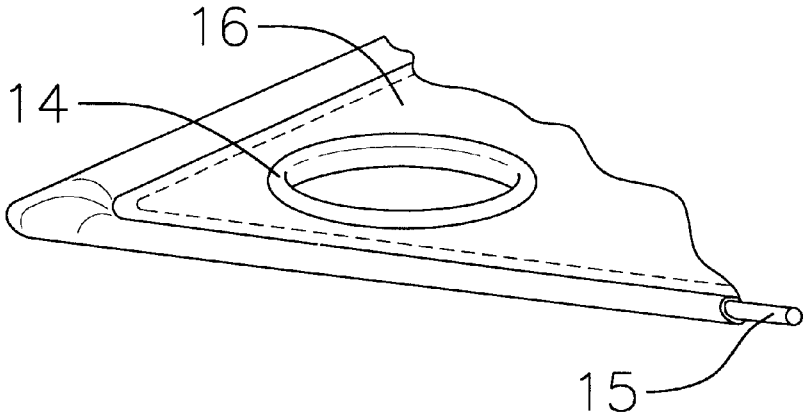
FIG. 4 depicts a closeup isometric view of a grommet and an associated comer from said tarp in the present invention.

Referring now to the present invention, FIG. 1 is a top view of tarp 16, which includes four comer mounted grommets 14, 22, 23 and 24, reinforcement rod 18, and reinforcement ring 15.

Tarp 16 would preferably be a lightweight square or rectangular cover fabricated of a breathable type water resistant fabric or solar screen material, having one of each of grommets 14, 22, 23 and 24 installed into each comer. The actual fabric used in the construction of tarp 16 can vary, depending on the climate of the area in which tarp 16 is being used.

FIG. 2 shows a side view of support pole 17, which also includes top mounted flange 2, toggle mechanism 4, and lock tab hole 6. FIG. 3 shows a side view of spike 17, which also includes lock tab 8, top mounted pole 11, and spike driver 10.

Grommets 14, 22, 23 and 24 are each located on a comer of tarp 16. A closeup view of one individual grommet is shown in FIG. 4, which also shows in detail reinforcement ring 15. Reinforcement ring 15 serves as a barrier on the outer edge of tarp 16 and is fixedly attached to tarp 16 to provide extra structural support.

Reinforcement ring 15 serves as a skeletal outer framework which tarp 16 can be sewn onto and provides extra rigidity for tarp 16 once tarp 16 is properly supported by a quartet of support poles 17.

Figure 5:
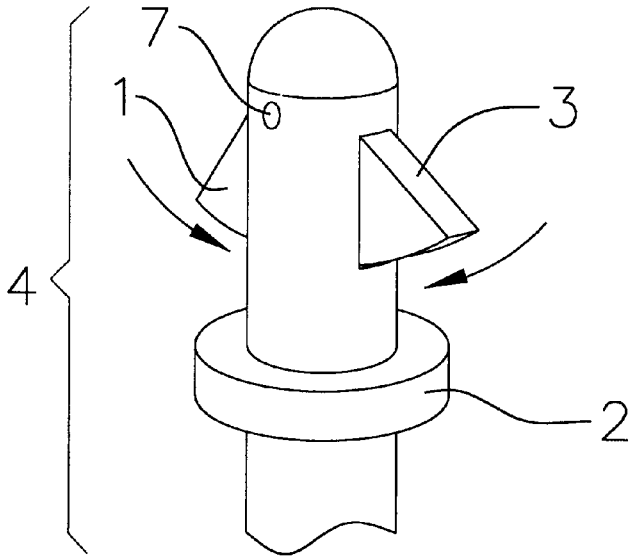
FIG. 5 depicts a closeup view of the top of a supporting pole, including the associated toggle mechanism associated with said support pole.
Figure 6:
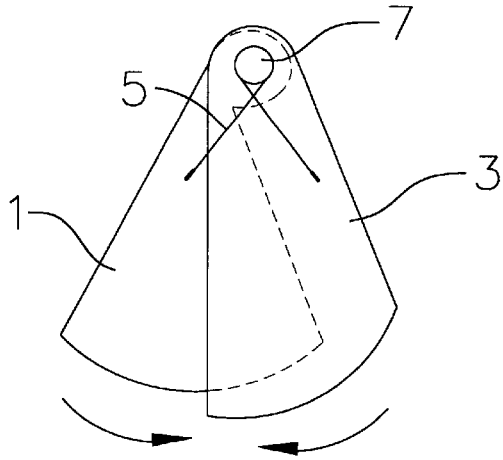
FIG. 6 shows a prospective view of the inner workings of said toggle mechanism located at the top of each support pole in the present invention.

Support pole 17 includes a top end and a bottom end, said top end including toggle mechanism 4. FIGS. 5 and 6 show close-up views of toggle mechanism 4, which includes toggles 1 and 3, flange 2, spring 5 and pivot 7.

Flange 2 is a cylindric disk fixedly mounted on the top of support pole 17. Pivot 7 is a small cylindrical pole rigidly mounted within support pole 17. Toggle 1 and 3 are mounted on pivot 7 and extend outward from support pole 17. Spring 5 provides an outwardly pushing force to insure toggles 1 and 3 are consistently being pushed out. Toggles 1 and 3 can be pushed down to allow user to mount an object on the top of any support pole 17, but spring 5 will cause toggles 1 and 3 to push outward once resistence from an object in direct contact with toggles 1 and 3 is no longer present. This mechanism will allow a user to place an object on top of a support pole 17 and not worry that said object will be blown off by the wind or will otherwise become detached by itself.

Figure 7:
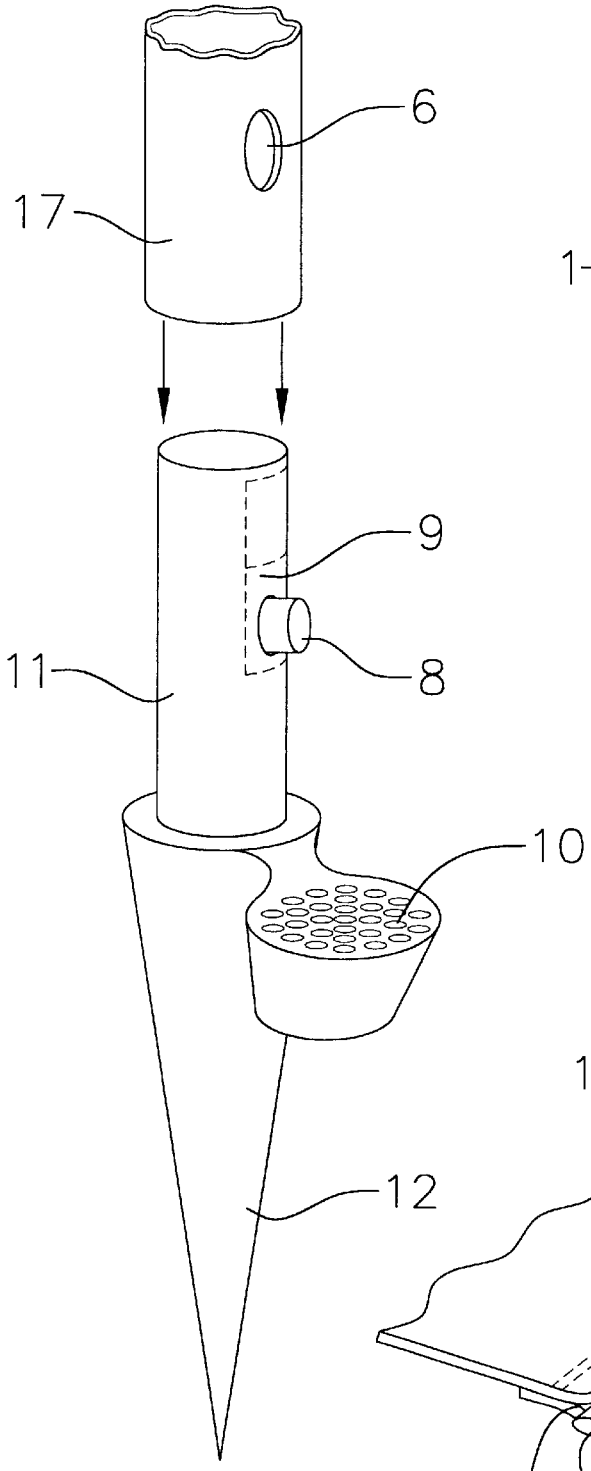
FIG. 7 is a closeup of each spike located in the present invention.

Referring now to FIG. 7, a closeup view of spike 12 is shown. Spike 12 is preferably composed of solid steel and includes lock tab 8, spring 9, spike driver 10, and top mounted pole 11. Spike driver 10 would be used as a surface in which a user could hammer spike 12 into the ground, and would also serve to aid in removing spike 12 with the claw of a hammer or other appropriate tool.

Spring 9 would be located inside of top mounted pole 11. Spring 9 would be in constant contact with lock tab 8, always pushing an outwardly type force against lock tab 8. Lock tab 8 is a button which can be pushed in by a user or by any other device, but once there ceases to be any force directed on lock tab 8, spring 9 will cause lock tab 8 to be forced outward once again.

Each support pole 17 contains a lock tab hole 6 located near the bottom of said support pole 17. Lock tab hole 6 is cylindrical and is designed to connect with lock tab 8. Each support pole 17 is designed to be large enough in diameter to slip over each top mounted pole 11. In such position, said lock tab 8 is designed to mate with lock tab hole 6, serving to lock the components together. The connection of these two parts insures that support pole 17 will not separate from spike 12, unless an individual chooses to push lock tab 8 in and forcibly remove support pole 17.

Figure 8:
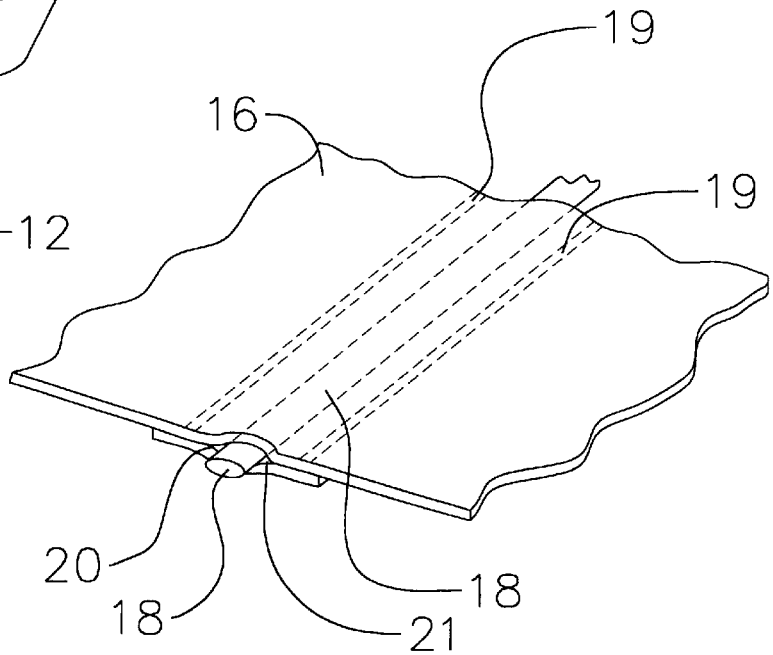
FIG. 8 is a closeup view of the reinforcement rod that runs through the tarp in the present invention.

Referring now to FIG. 8, reinforcement rod 18 is shown in a closeup perspective view. Reinforcement rod 18 is used only on larger models of the present invention to prevent rain water from gathering on the top of tarp 16. In addition, reinforcement rod 18 could be used to prevent excessive amounts of flapping due to high winds. Reinforcement rod 18 is connected to tarp 16 with the help of supporting fabric 20, which is a small strip of fabric which is fixedly fastened to the underside of reinforcement rod 18. Tarp 16 and supporting fabric 20 are then stretched together with stitching 19. Reinforcement rod 18 is thereby located within pocket 21 once it is correctly in place on tarp 16.

What I claim as my invention is:

1. A square or rectangular cover apparatus comprising:

(a) a lightweight tarpaulin type cover, the cover being fabricated from a water resistant fabric or solar screen material and including four corners, the cover further including four grommets rigidly embedded in the cover, each of the grommets being located on a corner of the cover, (b) four hollow tubular support poles, each of the support poles having an inner diameter and an outer diameter, each of the support poles further having a top end and a bottom end, whereby the top end of each support pole is removably connected with a corner on the cover, each support pole further including a toggle mechanism to removably connect a corner of the cover to support pole, whereby the bottom end of each of the support poles including a mounted circular aperture, whereby each toggle mechanism further includes a top-mounted flange fixedly attached to a support pole, a pivot horizontally mounted and located within support pole above the flange, a spring rigidly affixed to the pivot, a first toggle rotatably mounted on the pivot, and a second toggle rotatably mounted on the pivot; and (c) four spikes, each of the spikes being composed of solid steel and including a top-mounted pole, each top-mounted pole being hollow and having an outer diameter, each top-mounted pole further including a pushable lock tab which mates with the circular aperture located on the bottom end of a support pole, and each top-mounted pole having an outer diameter smaller than the inner diameter of the bottom end of a support pole.

2. A cover apparatus according to claim 1, wherein the spring attached to the pivot in the top end of the support pole provides an outward force against the first toggle and the second toggle, and the top end of the support pole includes apertures to allow the first toggle and the second toggle to extend outward from the support pole.

* * * * *